US006938986B2

(12) United States Patent
Macler et al.

(10) Patent No.: US 6,938,986 B2
(45) Date of Patent: Sep. 6, 2005

(54) SURFACE CHARACTERISTIC APPARATUS AND METHOD

(75) Inventors: Michel Macler, Corvallis, OR (US); Curt Nelson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 149 days.

(21) Appl. No.: 10/136,933

(22) Filed: Apr. 30, 2002

(65) Prior Publication Data

US 2004/0046807 A1 Mar. 11, 2004

(51) Int. Cl.[7] ..... B41J 2/135; B41J 2/14; B41J 2/16

(52) U.S. Cl. ..... 347/45; 347/47

(58) Field of Search ..... 347/12, 13, 40, 347/42, 44, 45, 47

(56) References Cited

U.S. PATENT DOCUMENTS

| | | | | |
|---|---|---|---|---|
| 4,550,326 A | | 10/1985 | Allen et al. | |
| 4,555,062 A | * | 11/1985 | You | 239/390 |
| 5,010,356 A | | 4/1991 | Albinson | |
| 5,189,437 A | | 2/1993 | Michaelis et al. | |
| 5,300,959 A | | 4/1994 | McClelland et al. | |
| 5,305,015 A | | 4/1994 | Schantz et al. | |
| 5,408,738 A | | 4/1995 | Schantz et al. | |
| 5,417,897 A | | 5/1995 | Asakawa et al. | |
| 5,434,606 A | | 7/1995 | Hindagolla et al. | |
| 5,595,785 A | | 1/1997 | Hindagolla et al. | |
| 5,598,193 A | * | 1/1997 | Halko et al. | 347/45 |
| 5,633,664 A | | 5/1997 | Bayat | |
| 5,748,216 A | | 5/1998 | Scheffelin et al. | |
| 6,120,131 A | | 9/2000 | Murthy et al. | |
| 6,123,413 A | | 9/2000 | Agarwal et al. | |
| 6,130,688 A | * | 10/2000 | Agarwal et al. | 347/47 |
| 6,254,219 B1 | | 7/2001 | Agarwal et al. | |
| 6,290,331 B1 | | 9/2001 | Agarwal et al. | 347/47 |
| 6,312,103 B1 | | 11/2001 | Haluzak | |
| 6,331,055 B1 | | 12/2001 | Miller et al. | 347/92 |
| 6,371,596 B1 | | 4/2002 | Maze et al. | |

FOREIGN PATENT DOCUMENTS

| | | | |
|---|---|---|---|
| EP | 0648803 | 4/1995 | C08J/7/12 |
| EP | 0694400 A2 | 1/1996 | B41J/2/16 |
| FR | 2747960 | 10/1997 | B41J/2/16 |

OTHER PUBLICATIONS

International Search Report maild Feb. 20, 2003 re Application No. PCT/US02/35780.

Patent Abstracts of Japan, vol. 2000, No. 02, Feb. 29, 2000 & Jp 11 310651 A (Hitachi Ltd), Nov. 9, 1999 abstract.

* cited by examiner

*Primary Examiner*—Michael S. Brooke

(57) ABSTRACT

A surface characteristic is determined by a property of a fluid capable of contacting the surface. The surface characteristic is based on the property of the fluid.

18 Claims, 7 Drawing Sheets

SURFACE CHARACTERISTIC APPARATUS AND METHOD

TECHNICAL FIELD

The present invention relates to a surface characteristic and a method of controlling a surface characteristic.

BACKGROUND OF THE INVENTION

Devices using fluid ejectors, such as inkjet printers, include a fluid cartridge in which fluid is stored and expelled through one or more orifices. Each orifice directs the fluid drop as it is ejected toward a target, such as print media. Because different fluids have different properties, however, the orifice may direct drops accurately for one type of fluid but not for another. As a result, the orifice may misdirect drops, adversely affecting drop placement precision.

Puddling is one characteristic that may affect fluid trajectory. Puddling basically involves the collection of extraneous fluid around the orifice, which occurs as a result of the fluid seeking to minimize its own surface energy. Undesirable fluid puddling may impede fluid drop expulsion through the selected orifice and can therefore be problematic if not avoided and/or minimized. Small puddles collecting in the orifice may, for example, create fluid trajectory errors due to tail hooking, especially if the fluid has a high surface tension. However, for low surface tension fluids, puddling may be desirable to control drop trajectory.

There is a desire for a structure that can optimize fluid drop direction based on a property of the fluid.

SUMMARY OF THE INVENTION

Accordingly, one embodiment of the invention is directed to a method of preparing a surface of a counterbore surrounding an orifice in an orifice layer, comprising the steps of determining a property of a fluid to be ejected through the orifice and controlling a surface characteristic of the counterbore surface based on the property of the fluid.

Another embodiment of the invention is directed to a fluid-ejecting apparatus, comprising a substrate with a fluid ejector, and an orifice layer containing at least one orifice through which fluid is ejected by the fluid ejector, wherein the orifice layer has a counterbore that surrounds the orifice and has a surface texture based on a property of the fluid ejected through the orifice.

A further embodiment of the invention is directed to an orifice layer for a fluid-ejecting apparatus, comprising at least one orifice through which fluid is ejected and a counterbore surrounding the orifice and having a surface characteristic based on a property of the fluid ejected through the orifice. Another embodiment of the invention is directed to a method of controlling wetting on a polymer surface comprising: laser treating the polymer surface to have a predetermined surface characteristic.

Another embodiment of the invention is directed to a method of controlling wetting on a polymer surface comprising laser treating the polymer surface to have a predetermined surface characteristic.

A further embodiment of the invention is directed to a surface having a wetting characteristic formed via laser treatment based on a predetermined property of a fluid capable of being on the surface.

Other embodiments of the invention will be apparent from the description below and the accompanying figures.

DETAILED DESCRIPTION OF THE EMBODIMENTS

Generally, one embodiment of the present invention is directed to a method of controlling a surface characteristic of a counterbore based on the properties of the fluid to be ejected through the orifice surrounded by the counterbore. The method includes determining a property of a fluid to be ejected through the orifice and controlling the surface characteristic of the counterbore based on the fluid property. Other embodiments of the invention are directed to an orifice layer and a fluid-ejecting device having a counterbore surface characteristic based on a fluid property. Although the embodiments described below focus primarily on surface texture, the invention is also applicable with respect to other surface characteristics, such as chemical composition, chemical inhomogeneity, chemical reactivity, physical and chemical adsorptivity, and any other characteristics that may affect fluid behavior in the orifice and the counterbore.

Figure 1:
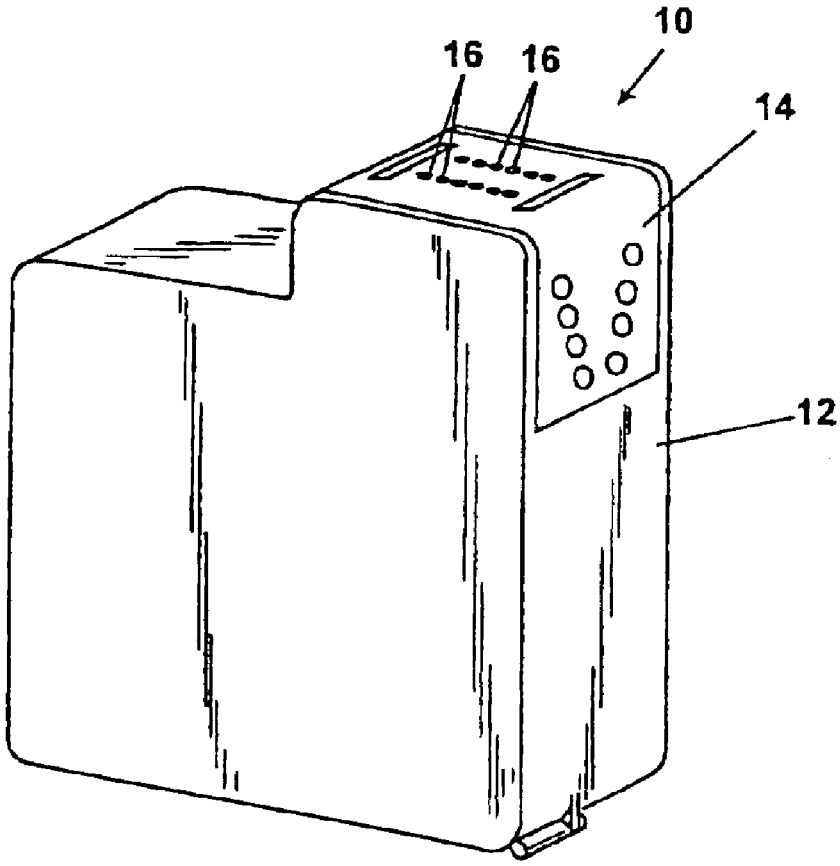
FIG. 1 illustrates a print cartridge according to one embodiment of the invention.

One possible application for the invention is in a fluid ejection cartridge 10, such as a print cartridge assembly, which is shown generally in FIG. 1. The cartridge 10 shown in FIG. 1 is representative of a typical print cartridge for use in an inkjet printer, but the cartridge may be used to eject other fluids in other applications as well. Cartridge 10 includes a body 12 that may serve as an fluid containment device and typically is made of a rigid material such as an engineering plastic. Specific examples of materials that may be used in the fabrication of the body include: engineering plastics such as liquid crystal polymer (LCP) plastic, polyphenylene sulfide, (PPS), polysulfone (PS) and blends as well as nonpolymeric materials such as ceramics, glasses, silicon, metals and other suitable materials. An orifice layer, such as an orifice plate 14, is mounted to the body 12 and includes orifices 16 through which fluid drops are expelled by any one of a number of drop ejection systems.

Figure 2:
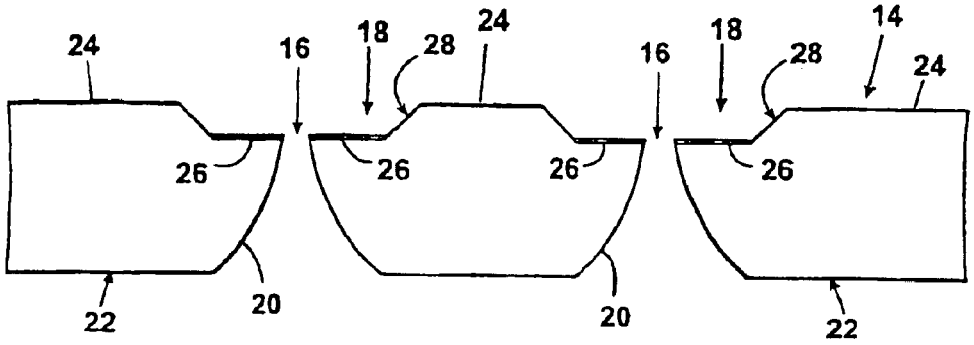
FIG. 2 is a representative diagram of one embodiment of an orifice layer.

FIG. 2 illustrates one possible orifice plate structure 14 having a counterbore 18 surrounding each orifice 16. The orifice plate 14 may be incorporated into any fluid-ejecting device and is not limited to use in a print cartridge 10. Note that FIGS. 2 through 4 and 8 are representative diagrams only and are not necessarily drawn to scale. The orifice plate may be made of KAPTON® E in this example; however, the orifice plate 14 may also be manufactured from other materials, such as polyimide, polyethylene naphthalate, polyethylene terephtalate, other KAPTON® formulations, flex material, Upilex™, or any other substrate that can be treated in accordance with embodiments of the present invention. In one embodiment, the nozzles are formed by ablating the orifice plate 14 from an inner surface 22 (the surface closest to a fluid source) of the plate 14 with a laser or other means to form the orifices 16. The conical shape of at least a portion of the orifice forms a nozzle position 20 of the orifice 16. A depression is then formed around the orifice 16 on an outer surface 24 of the plate 14 to create the counterbore 18. The nozzles 20 directing fluid through the orifices 16 have been shown as generally funnel-shaped in section. It is understood, however, that the nozzles 20 may have any one of a variety of shapes.

In one embodiment, at least one counterbore 18 concentrically surrounds each orifice 16 in the orifice plate 14. The counterbore 18 in one embodiment begins at the outer surface 24 thereof and terminates at a position within the orifice plate 14 between the outer surface 24 and inner surface 22. The counterbore 18 includes a counterbore surface 26 and side walls 28 that define the internal boundaries of the counterbore 18. The texture and/or composition of the counterbore surface 26 may affect fluid puddling action around the orifice 16. The cross-sectional design of the counterbore 18 may involve many different configurations without limitation including, but not limited to, those that are square, triangular, oval-shaped, and circular. The counterbore 18 surrounds the orifice 16, protecting the orifice 16 edges from physical damage and "ruffling" caused by physical abrasion and external forces. Ruffling of the orifice plate 14 causes uplifted ridge-like structures to form along the peripheral edges of the orifices 16, causing significant changes in drop trajectory.

These undesired changes in orifice plate geometry may prevent the fluid drop from travelling in its intended direction. If the counterbore surface 26 and/or the orifice plate 14 geometry is not optimized to accommodate the ejected fluid's particular properties, the fluid drop may be expelled improperly and be delivered to an undesired location on, for example, the print media material. In one embodiment, isolating the orifice 16 via the counterbore 18 protects the orifice 16 from damage caused by the passage of wipers and other structures over the outer surface 24 of the orifice plate 14. In this manner, "ruffling"-based fluid trajectory problems may be avoided.

The inner surface of the orifice plate 14 is exposed to the fluid supply. The fluid flows past the inner surface 22 through orifice 16. Note that different fluids having different properties may flow through different orifices 16 in the same orifice plate 14. Preferably, the inner surface 22 of the orifice plate 14, including the conical nozzle portion 20, should facilitate the fluid flow from a supply through the orifice 16. However, some of the fluid that is ejected through the orifice 16 does not reach its target (such as paper or other print medium) and instead collects in the counterbore 18.

For example, in the thermal inkjet print cartridge 10 according to one embodiment, a drop ejection system (not shown) is associated with each orifice 16 to selectively eject drops of ink 30 through the orifice 16 to a print medium, such as paper. There may be several orifices 16 formed in a single orifice plate 14, each orifice 16 having an associated drop ejection system for supplying a drop of ink on demand as the printhead scans across a printing medium. The drop ejection system may include a thin-film resistor (not shown) that is intermittently heated to vaporize a portion of fluid, such as ink, near an adjacent orifice 16. In this embodiment, the rapid expansion of the fluid vapor creates a bubble that forces a drop of ink 30 through the orifice 16. After the bubble collapses, the ink 30 is drawn by capillary force into the nozzle 20 of the orifice plate 14. A partial vacuum or "back pressure" is maintained within the pen to keep ink 30 from leaking out of the orifice 16 when the drop ejection system is inactive. In one embodiment, the back pressure keeps the ink 30 from passing completely through the orifice 16 in the absence of an ejecting force. Whenever drops of ink 30 are not being ejected through the orifice 16, the ink 30 resides with a meniscus 32 just inside the outer edge of the orifice 16.

Whenever a fluid drop 30 is ejected through the orifice 16, a trailing portion or "tail" of fluid moves with the drop. A small amount of the fluid tail may separate and collect on the counterbore surface 26. Residual fluid that collects in the counterbore 18, which is affected by the surface texture of the counterbore surface 26, may contact subsequently ejected fluid drops and possibly alter the trajectory of those drops. In an inkjet printer application, this phenomenon reduces the quality of the printed image for certain inks while improving print quality for other inks.

Figure 3:
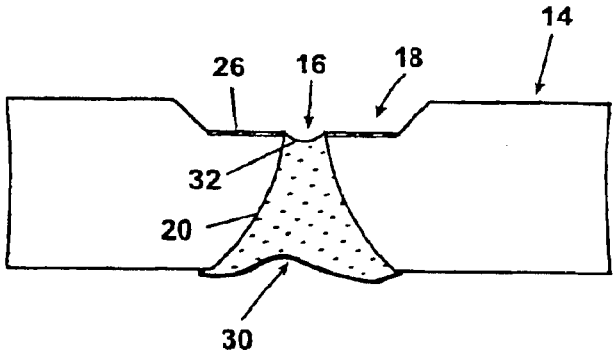
FIG. 3 is a representative diagram of one embodiment of an orifice layer with a fluid drop in a counterbore having an example of a first surface texture.

Changing the surface texture 26 of the counterbore 18 changes the wettability of the counterbore 18, which dictates the degree to which fluid collects, or puddles, in the counterbore 18. The wetting characteristics of a surface 26 may be "wetting" or "non-wetting" and may also vary along a range within and between each category. "Wetting" means that the surface energy of the counterbore surface 26 is greater than that of the fluid that is in contact with the surface, while "non-wetting" means that the surface energy of the counterbore surface 26 is less than that of the fluid that is in contact with the surface. Fluid tends to bead on non-wetting surfaces and spread over wetting surfaces. With respect to a counterbore structure 18 having a wetting surface 26 shown in FIG. 4, for example, fluid tends to collect as a puddle 40 inside the counterbore 18. By contrast, the example shown in FIG. 3 is representative of a counterbore 18 having a non-wetting surface 26. The optimal counterbore surface texture, as well as the degree and desirability of puddling in the counterbore, depends on the one or more properties of the fluid being ejected through the orifice 16. In one embodiment, the fluid properties taken into account are surface tension, viscosity, chemical composition, and/or chemical reactivity of the fluid. Although the examples below focus on surface tension, similar considerations in the invention also apply with respect to the other properties and can be determined from the present disclosure by those of ordinary skill in the art.

Figure 4:
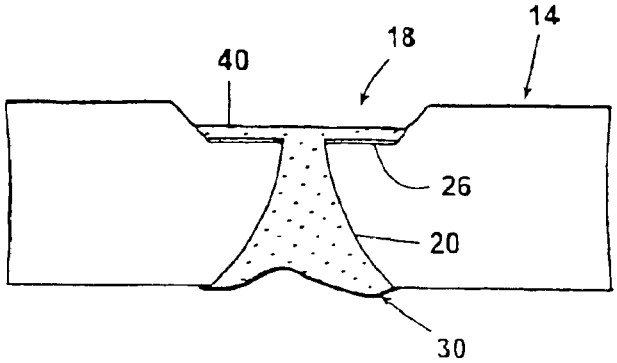
FIG. 4 is a representative diagram of one embodiment of an orifice layer with a fluid drop in a counterbore having an example of a second surface texture.

Puddling may be desirable for low surface tension fluids, such as color inks, because drops ejected through a thin, uniform puddle in the counterbore 18 have a straight trajectory. In this embodiment, the uniform puddle ensures that there is no preferential area in the puddle 40 for the fluid to attach and change the drop trajectory toward the preferential area. In one embodiment, the puddle 40 in the counterbore 18 is relatively flat due to the fluid's low surface tension. Thus, the counterbore surface 26 for fluids having a surface tension below a "low" surface tension threshold as generally characterized in the art (e.g. color inks) is rough in one embodiment to encourage puddling in the counterbore (FIG. 4). However, for fluids having a surface tension above a "high" surface tension threshold as generally characterized in the art (e.g., black ink), puddling in the counterbore is undesirable because the fluid tends to form a puddle having an outwardly curved surface that adversely affects the fluid drop trajectory as drops move through the puddle. For example, high surface tension fluids may alter drop trajectory by causing an undesired interaction between the drop being expelled (particularly the terminal portion of each drop, or its "tail") with a puddle in the counterbore 18. Thus, the counterbore surface 26 for high surface tension fluids should be smooth in one embodiment to discourage puddling in the counterbore 18 (FIG. 3). Optimizing the puddling characteristics of the counterbore surface 26 for both low and high surface tension fluids can be achieved in accordance with the present invention by selecting an appropriate laser fluence and shot count to achieve a desired degree of counterbore surface 26 roughness or smoothness based on the fluid's properties. In short, the counterbore surface 26 texture in one embodiment of the invention is optimized and controlled based on the properties of the fluid being ejected through the orifice surrounded by the counterbore 18.

Figure 5:
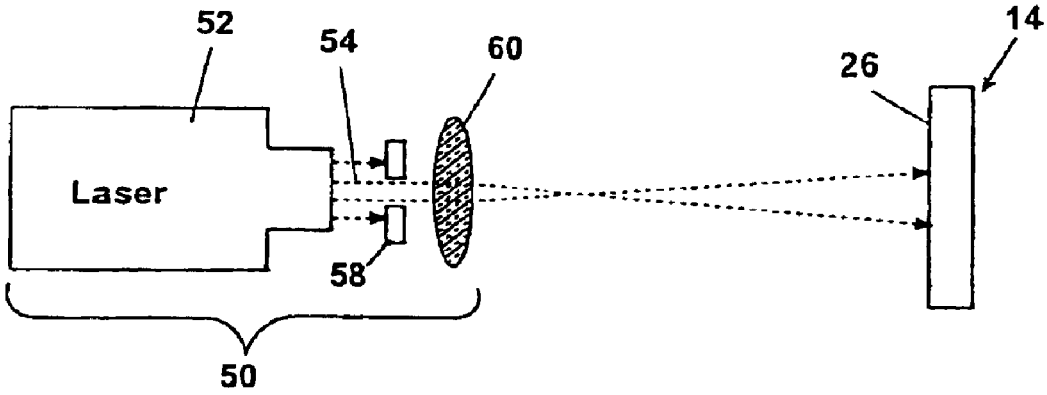
FIG. 5 is a representative diagram of one embodiment of a laser system and process according to one embodiment of the invention.

Referring to FIG. 5, one technique for achieving the selected wetting characteristics just mentioned with respect to a given fluid property is described with respect to, for example, a KAPTON® E orifice plate 14. The outer surface 24 of orifice plates that are formed of KAPTON® E or other polymers are generally non-wetting with respect to certain inks. In alternative embodiments, any number of techniques may be employed for altering the surface texture of the counterbore surface 26 in the orifice plate 14 to obtain a desired wetting characteristic. Two possible methods are described in greater detail below.

One possible method of controlling the counterbore surface 26 texture based on a fluid property is via laser ablation. Any known laser ablation system and process can be used to control the counterbore surface texture, such as an excimer laser of a type selected from the following non-limiting alternatives: $F_2$, ArF, KrCl, KrF, or XeCl. One possible laser ablation method of this type is described in, for example, U.S. Pat. No. 5,305,015 to Schantz et al. In one embodiment, masks or a common mask substrate define ablated features. The masking material used in such masks will preferably be highly reflecting at the laser wavelength, such as a multilayer dielectric or a metal such as aluminum. Using this particular system (along with preferred pulse energies of greater than about 100 millijoules/sq. cm. and pulse durations shorter than about 1 microsecond), the counterbore surface texture can be controlled with a high degree of accuracy and precision. Further, the embodiment may use other ultraviolet light sources with substantially the same optical wavelength and energy density as excimer lasers to accomplish the ablation process. In one embodiment, the wavelength of such an ultraviolet light source will lie in the 150 nm to 400 nm range to allow high absorption in the mask to be ablated.

An ablation system for polymer orifice plates based on frequency-multiplied Nd:YAG lasers as well as excimer layers may also be used in the invention. One example of such a system is described in U.S. Pat. No. 6,120,131, to Murthy et al. In one embodiment, the surface to be ablated is overlaid with an adhesive layer coated with a sacrificial layer. The sacrificial layer may be any polymeric material that is both coatable in thin layers and removable by a solvent that does not interact with the adhesive layer or the surface. Possible sacrificial layer materials include polyvinyl alcohol and polyethylene oxide, which are both water soluble. The laser ablation process itself may be accomplished at a power of from about 100 millijoules per sq. cm. to about 5,000 millijoules per sq. cm., and preferably about 1,500 millijoules per centimeter squared. During the laser ablation process, a laser beam with a wavelength of from about 150 nanometers to about 400 nanometers, and most preferably about 248 nanometers, may be applied in pulses lasting from about one nanosecond to about 200 nanoseconds, and preferably about 20 nanoseconds.

Other methods are also suitable for controlling the counterbore surface texture, including conventional ultraviolet ablation processes (e.g., using ultraviolet light in the range of about 150–400 nm), as well as standard chemical etching, stamping, reactive ion etching, ion beam milling, mechanical drilling, and similar known processes.

More particularly, a laser system 50 in which one embodiment of the present invention may be implemented is shown generally in FIG. 5. The laser system 50 includes a laser 52 configured to direct laser light 54 (e.g., photons) at the counterbore surface 26 of the orifice plate 14, a portion of which may be covered by one or more masks (not shown) so that only selected portions of the orifice plate 14 (e.g., the counterbore surface 26 area) are ablated. Note that any laser that is capable of ablating the counterbore surface 26 may be used, including gas, liquid and solid state lasers as well as any other light source that provides sufficient fluence to remove the orifice plate 14 material in a controlled manner. Chemical gas lasers, such as excimer lasers, may be used if the orifice plate material can absorb radiation in the UV wavelength range. By choosing a source that provides the desired wavelength, one can also treat other materials that may be ablated with longer or shorter wavelengths. Typically, excimer lasers operate in the UV range. The optimal laser parameters for the method, including intensity, repetition rate and number of pulses, typically will depend on the substrate material and the specific arrangement of the laser system as described in the present example.

As illustrated in FIG. 5, the laser 52 may be directed toward the counterbore surface 26 where the laser light 54 impinges upon the surface of the surface 26. The laser light 54 emitted from the laser 52 may be directed through a beam stop 58 which functions to direct a portion of the laser light emitted from laser 52 toward the counterbore surface 26. The laser light 54 may also be directed through one or more lenses 60, which may focus laser light 54 onto the counterbore surface 26 of the orifice plate 14. Those skilled in the art will recognize that there are a number of ways to condition the laser light and direct it towards the counterbore surface 26 other than the simple method described above. For example lenses, masks, mirrors, beam stops, attenuators and polarizers are typical elements used to condition light. It is also useful to provide for the mounting and positioning of the part in front of the beam. Parts may be flood treated or may be moved across the beam using an X-Y stage or turning mirror apparatus may be used to scan the beam across the part.

In one embodiment, the fluence of the laser may be adjusted to cause ablation of the surface 26 of the counterbore 18. Fluence, as used herein, refers to the number of photons per unit area, per unit time. Ablation, as used herein, refers to the removal of material through the interaction of the laser with the counterbore surface 26. Through this interaction, the counterbore surface 26 is activated such that the surface bonds are broken and surface material is displaced away from the counterbore surface 26, thereby changing the surface texture of the counterbore surface 26.

The fluence of the laser 52 typically is adjusted based on the characteristics of the counterbore material to be ablated as well as the desired counterbore surface texture, which will be explained in greater detail below. In one embodiment, laser light 54 is directed to areas of the orifice plate 14 that are intended to receive the laser surface treatment (e.g., the counterbore surface 26), while areas that do not require laser surface treatment may be masked off, or otherwise not exposed to the laser light 54, so that they remain unaltered.

The actual texture of the counterbore surface 26 obtained via laser ablation may depend on the number of pulses, pulse width, pulse intensity, frequency, density of initiators in the laser 52, the type of material in the counterbore surface 26 and/or the type of initiator employed. In one embodiment, the fluence typically should exceed a predetermined threshold before ablation of the counterbore surface 26 occurs. If the fluence is below this threshold, then there will be little or no ablation and no removal of the counterbore surface material. The ablation threshold is dependent on the characteristics of the material being ablated and the light source. In laser ablation, short pulses of intense laser light are absorbed in a thin surface layer of material within about 1 micrometer or less of the counterbore surface 26. Preferred pulse energies are greater than about 100 millijoules per square centimeter and pulse durations are shorter than about 1 microsecond.

The surface texture itself can be defined and quantified by a "contact angle" value, which is the angle of intersection between the counterbore surface 26 and a fluid drop. A high contact angle, for example, corresponds with a smoother, non-wetting surface, while a low contact angle corresponds with a rougher, wetting surface. In one embodiment, a contact angle of 10 degrees or less corresponds with a "highly wettable" surface that causes a fluid to spread extensively, or "wets out", over the surface. A contact angle between 10 and 90 degrees corresponds with a wetting surface. A contact angle of 90 degrees or greater corresponds with a non-wetting surface.

Figure 6A:
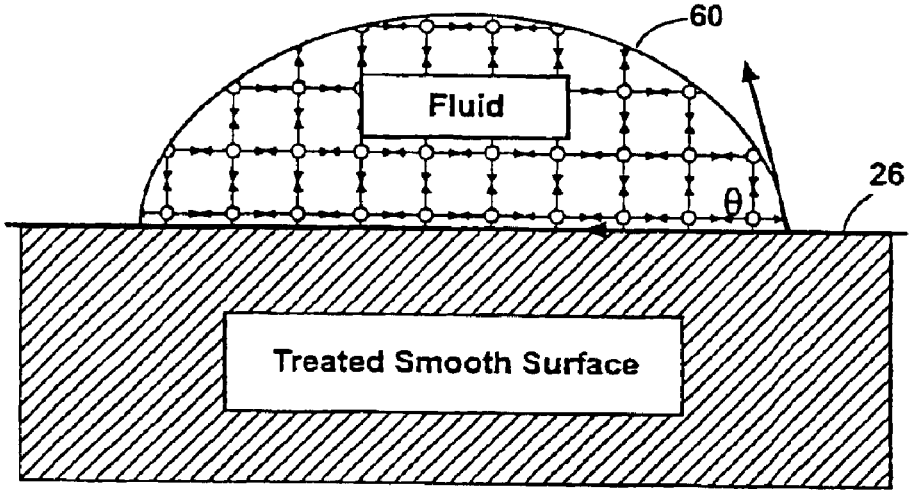
FIG. 6A is a representative diagram of an example of a fluid on a treated smooth surface, resulting in a high contact angle.
Figure 6B:
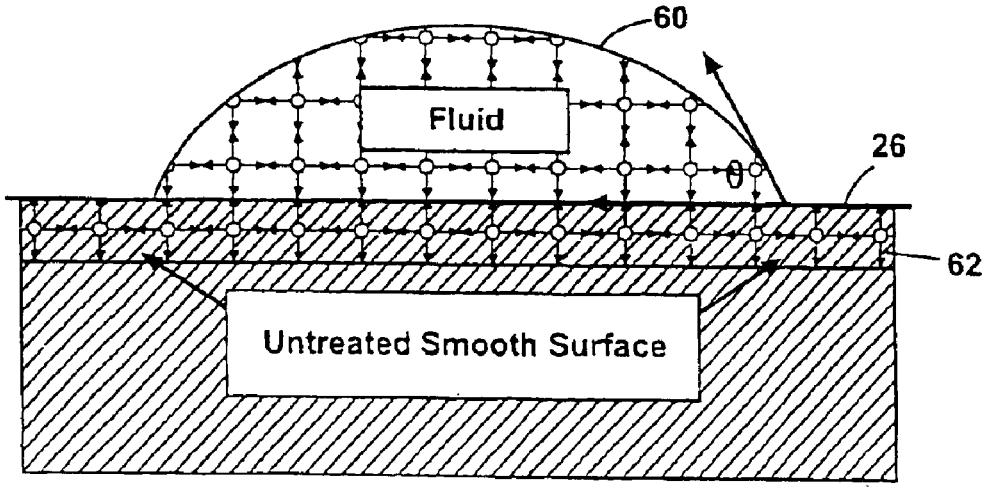
FIG. 6B is a representative diagram of an example of a fluid on an untreated smooth surface, resulting in a low contact angle.
Figure 7:
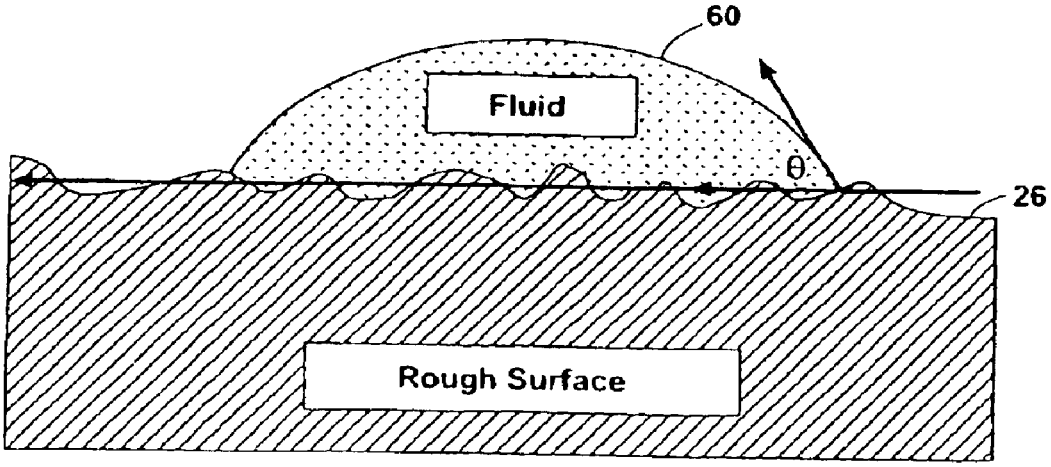
FIG. 7 is a representative diagram of an example of a fluid on a rough surface, resulting in a low contact angle.

FIGS. 6A, 6B and 7 illustrate examples of relationships between the counterbore surface 26 and a drop of fluid 60 and the resulting contact angles of different surface textures. As can be seen in FIG. 6A, a smooth, treated counterbore surface 26 may cause the fluid 60 to bead and sit in a more upright manner at the intersection between the fluid 60 and the surface 26; in this example, the angle of intersection is a little less than 90 degrees. If the surface is left untreated, as shown in FIG. 6B, the surface texture of the counterbore surface may still be smooth, but the untreated surface may have an adsorption layer or oxidized surface 62 caused by, for example, the chemistry of polymer termination or by chemical/physical adsorption of oxygen-containing chemicals at the surface 26. The adsorption layer or oxidized surface 62 causes the fluid 60 to have a lower contact angle than the treated surface shown in FIG. 6A. As can be seen in FIG. 6A, treating the counterbore surface 26 removes the adsorption layer or oxidized surface 62, changing the interaction between the counterbore surface 26 and the fluid 60.

The example shown in FIG. 7, however, shows that a rougher counterbore surface 26 will encourage the fluid drop 60 to spread, creating a smaller angle at the angle of intersection between the surface 26 and the fluid 60. This spreading action and corresponding low contact angle indicates that the fluid 60 is more likely to cling to the surface 26, or "wet" the surface, rather than bead. As a result, a smoother counterbore surface would be considered a "non-wetting" surface, while a rougher counterbore surface would be considered a "wetting" surface.

Note that laser ablation of the counterbore surface 26 may produce surface debris having a different chemical composition than the ablated surface or the original, unablated surface. For example, a high-fluence laser treatment may leave carbon-rich debris on the surface 26. This debris may change the wettability characteristics of the counterbore surface 26. Depending on the desired wettability characteristics and the specific application, the debris may be left on the counterbore surface 26 or removed through any known means.

Figure 8:
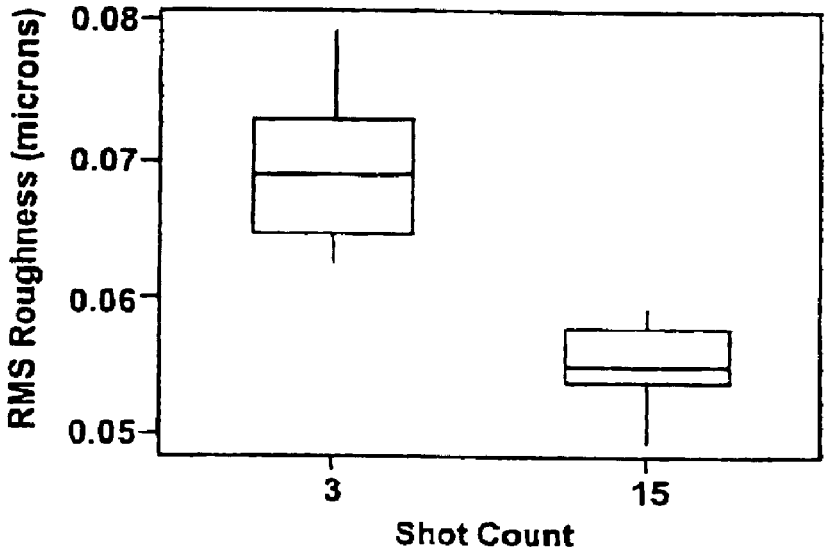
FIG. 8 is a graph illustrating an example of a laser process result according to one embodiment of the invention.
Figure 9:
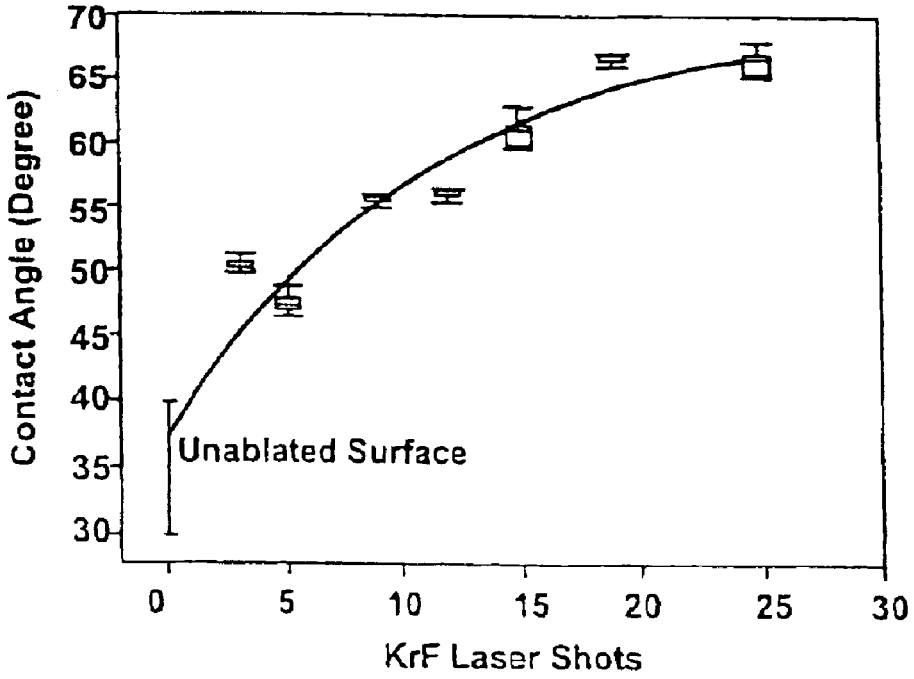
FIG. 9 is a graph illustrating an example of an effect of one embodiment of a laser process on wettability.

FIG. 8 illustrates an example of the effects of a laser ablation shot count on counterbore surface texture in one embodiment, while FIG. 9 illustrates a relationship between a contact angle of the counterbore surface 26 in a KAPTON® E orifice plate 14 and the ablation shot count in one embodiment. As is known in the art, the shot count of the laser corresponds to the laser fluence. Varying the fluence involves varying the shot count and, as explained above, changes the final surface texture and wettability of the counterbore surface 26. Changing the laser ablation fluence, the actual focus of the laser and the number of pulses per unit time all can vary the resulting surface texture generated via laser ablation. In one embodiment, a lower shot count corresponds to a higher fluence because each individual shot is at a higher energy level, while a higher shot count corresponds to a lower fluence because each individual shot is at a lower energy level even though there are more shots in a given unit of time.

In the example shown in FIG. 8, low shot counts for a KrF laser surface treatment may result in a counterbore surface 26 having a high roughness (and therefore high wettability). Conversely, high shot counts may result in a smoother, lower wettability counterbore surface 26. Note that in this example, ablation of any kind increases the contact angle of the counterbore surface, regardless of the shot count; however, the total number of shot counts greatly affects the resulting contact angle, and thus the wettability, of the counterbore. In one embodiment, the counterbore depth is kept consistent between different counterbores regardless of surface texture. To accomplish this, one embodiment reduces the laser energy setting and increases attenuation when increasing the shot count; conversely, the embodiment may also increase the laser energy setting and decrease attenuation when decreasing the shot count.

FIG. 9 illustrates one example of an effect of a KrF laser surface treatment on the wettability of a KAPTON® E surface. In this example, the counterbore depth is kept at 1.1 um, regardless of the specific shot count, by adjusting the ablation fluence for each counterbore. As shown in the example of FIG. 9, the contact angle for de-ionized water is around 30 to 40 degrees before the counterbore surface is ablated. After ablation, however, the contact angle increases to varying degrees, and thus wettability, depending on the specific shot count. Varying the shot count significantly changes the contact angle. For example, the contact angle for the counterbore surface after 5 shots is between 45 to 50 degrees, but 10 shots increases the contact angle to 55 degrees, indicating a significantly less wettable surface.

Changing the laser's focus may also affect the counterbore surface texture. In one embodiment, changes in the laser's focus changes the contact angle of the counterbore surface.

The specific fluence values for obtaining an optimum counterbore surface texture based on a given fluid property can be obtained via basic experimentation. Due to the many possible surface tension characteristics of different fluids, specific optimum values for the shot count and fluence and their resulting surface textures may be different for each individual fluid. The optimum values for each fluid can be obtained via experimentation according to the inventive method and are within the capabilities of those of ordinary skill in the art.

Figure 10:
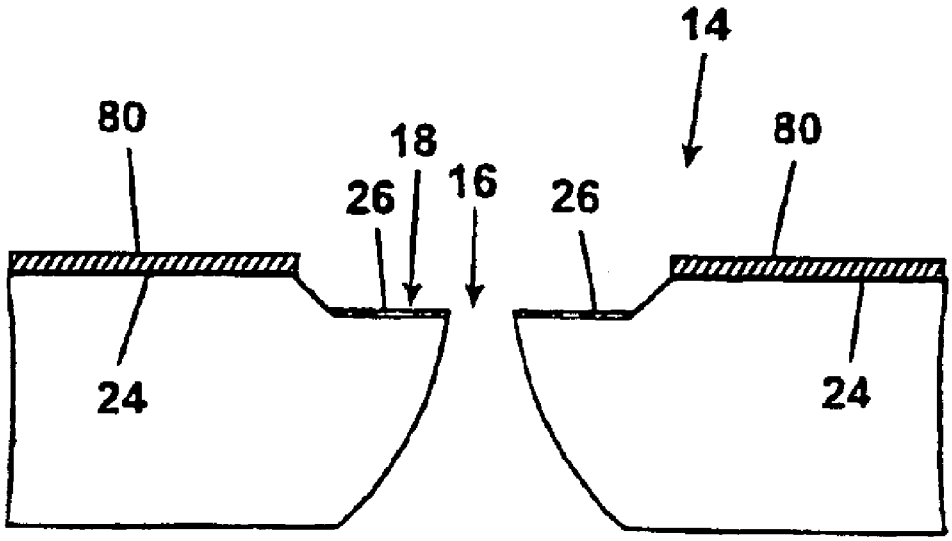
FIG. 10 illustrates an etching system and process according to one embodiment of the invention.

FIG. 10 illustrates another embodiment of the invention. In this embodiment, the counterbore surface texture is controlled via an etching process rather than via laser ablation. The etching can be conducted via any known process, such as the process described U.S. Pat. No. 5,595,785, the disclosure of which is incorporated by reference herein in its entirety. The outer surface 24 of the counterbore 18 surrounding the orifice 14 is covered photoresist layer 80 applied by any known means. The photoresist layer 80 exposes the counterbore surface 26 and protects the covered outer surface 24 from the plasma etching process.

With the exposed photoresist material covering the areas surrounding the counterbore 18, the counterbore surface 26 can be etched (e.g., via plasma etching or reactive ion etching) to control the counterbore surface texture. In one embodiment, the orifice plate, with photoresist material 80 covering the outer surface portions 24, is placed within a vacuum chamber of a conventional plasma etching or reactive ion etching apparatus. The orifice plate 14 is exposed to oxygen that is preferably applied at a pressure range of between 50 and 500 millitorr and more preferably at 200 millitorr. The power applied to electrodes of the etching apparatus is preferably in a range of 5 to 500 watts and most preferably 100 watts. The orifice plate 14 is exposed to the plasma for approximately 5 minutes.

It can be appreciated that any of a number of combinations of parameters (pressure, power, and time) of the plasma etching process may be used to etch the exposed counterbore surface 26. It is contemplated in one embodiment, therefore, that any combination of the parameters will suffice as long as the exposed surface portions (that is, the portions not covered with a layer of photoresist material) can be etched to create a counterbore surface texture optimized for a given fluid property, such as surface tension, as explained above.

Note that a laser ablation process may be preferred over a masking process, such as a photolithographic/photoresist process, to form a hydrophobic/hydrophilic thin layer because in one embodiment, the laser ablation process is more exact and can precisely create optimal surface textures in the counterbore surface 26 without affecting any surfaces outside of the counterbore 18. Further, the laser ablation process can be applied to surfaces below the main surface of a device, an advantage that is more difficult to achieve via masking processes. The above-described laser ablation process, by virtue of its threshold phenomena and use of pre-polymerized materials, produces highly predictable patterns dependent upon the incident energy per unit area (fluence) and provides greater control over the counterbore surface texture while ensuring that the area surrounding the counterbore is not affected by the ablation process.

Although the above embodiments focus on controlling a counterbore surface texture, the invention may be applied to other portions of the orifice layer, such as a top surface or an inner bore surface. Also, the invention may be applied to any item where control over a surface wetting characteristic is desired and is not limited to orifice layers. Other possible applications where precise surface treatments are desirable include applications that locate biologically active materials such as proteins or enzymes, chemical force microscopy, metallization of organic materials, corrosion protection, molecular crystal growth, alignment of liquid crystals, pH sensing devices, electrically conducting molecular wires, and photoresists. Further, although the description above focuses on the characteristics of ink, the invention is applicable with respect to other fluids, such as a silane coupling agent (e.g., hexanediamino-methyidiethoxysilane), a self-assembled monolayer (e.g., an alkylsiloxane), a precursor for an organic semiconductor (e.g., poly(3,4-ethylenedioxythiopene) doped with polystyrene sulfonic acid), a biologically active liquid, or any other fluid whose behavior can be affected by the characteristics of the surface.

As a result, the invention can customize one or more counterbore surface characteristics based on a fluid property to optimize drop directionality. In an inkjet printhead, for example, if an orifice in the printhead will eject black ink, which has relatively high surface tension, a smooth surface can be created on the counterbore so that the surface resists forming an ink puddle having a high contact angle. Conversely, if an orifice in the printhead will eject color ink, which has relatively low surface tension, the counterbore surface can be formed with a rough surface that can fill with a low contact angle ink puddle. Further, the invention can provide even more refined counterbore surface characteristics based on the properties of each individual fluid ejected through each individual orifice in the same device ink color. For example, within color ink sets, subtle differences in the wetting rates of inks of different colors may warrant corresponding subtle differences in the wettability of the counterbore surface for each corresponding ink color ejected by the printhead. To accommodate the properties of different inks being ejected through different orifices in the same orifice plate, each orifice may have a different surface texture corresponding to the properties of the specific ink being ejected through each orifice.

By varying the counterbore surface to accommodate different fluid properties, the invention minimizes drop trajectory errors as ink drops exit the orifice. In one embodiment, if a laser process is used to modify the counterbore surface, different surface textures having different wettabilities can be obtained simply by tuning the laser process. As a result, customizing the wettability of each counterbore based on the specific properties of the fluid to be ejected through the orifice surrounded by the counterbore can optimize drop directionality for each individual fluid. Note that although the above description focuses primarily on laser ablation and etching techniques for customizing the counterbore surface texture based on varying fluid properties, other methods (e.g., mechanical abrasion, sand blasting, ion beam milling, and molding or casting on a photodefined pattern. etc.) can be used without departing from the scope of the invention.

Note that the present invention has been described above in part with respect to inkjet technology. The term "inkjet printhead" as used in this discussion shall be broadly construed to encompass, without restriction, any type of printhead that delivers liquid ink to a print media material. In this regard, the invention shall not be limited to any particular inkjet printhead designs, with many different structures and internal component arrangements being possible. Likewise, the invention shall not be restricted to any particular printhead structures, non-inkjet fluid technologies, or fluid ejector types unless otherwise stated herein and is prospectively applicable.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A fluid-ejecting apparatus, comprising:

a substrate with a fluid ejector; and an orifice layer containing at least one orifice through which fluid is ejected by the fluid ejector, wherein the orifice layer has a counterbore that surrounds the orifice and has a surface characteristic based on a property of the fluid ejected through the orifice, the surface characteristic being at least one selected from the group consisting of surface texture, chemical composition, chemical inhomogeneity, chemical reactivity, physical adsorptivity, and chemical adsorptivity; and wherein the orifice layer includes at least a first orifice surrounded by a first counterbore and a second orifice surrounded by a second counterbore; and wherein the first orifice ejects a first fluid having a first property and the second orifice ejects a second fluid having a second property, and wherein the surface texture of the first counterbore is based on the first property and the surface texture of the second counterbore is based on the second property.

2. The fluid-ejecting apparatus of claim 1, wherein the surface texture of the first counterbore is different than the surface texture of the second counterbore.

3. The fluid-ejecting apparatus of claim 1, wherein the first property and the second property are at least one selected from the group consisting of surface tension, viscosity, chemical composition, and chemical reactivity.

4. An orifice layer for a fluid-ejecting apparatus, comprising:

at least one orifice through which fluid can be ejected; and a counterbore surrounding the orifice and having a surface characteristic based on a property of the fluid to be ejected through the orifice, the surface characteristic being at least one selected from the group consisting of surface texture, chemical composition, chemical inhomogeneity, chemical reactivity, physical adsorptivity, and chemical adsorptivity; and wherein the orifice plate includes at least a first orifice and a second orifice; and wherein the first orifice ejects a first fluid having a first property and the second orifice ejects a second fluid having a second property, and wherein the surface texture of the first counterbore is based on the first property and the surface texture of the second counterbore is based on the second property.

5. The orifice layer of claim 4, wherein the surface texture of the first counterbore is different than the surface texture of the second counterbore.

6. The orifice layer of claim 4, wherein the first property and the second property are at least one selected from the group consisting of surface tension, viscosity, chemical composition, and chemical reactivity.

7. The orifice layer of claim 6, wherein the first property and the second property have different values, and wherein the surface texture of the first counterbore is different than the surface texture of the second counterbore based on the difference in the first property and the second property.

8. A fluid-ejecting apparatus, comprising:

a substrate with a fluid ejector for ejecting at least a first fluid with a first surface tension; and an orifice layer comprising at least a first orifice through which the first fluid is ejected, wherein the orifice layer has a first counterbore that surrounds the first orifice, and wherein the first counterbore has a first surface texture selected based at least in part on the first surface tension;

wherein the orifice layer further comprises a second orifice through which a second fluid having a second surface tension is ejected, wherein the orifice layer has a second counterbore that surrounds the second orifice, wherein the second counterbore has a second surface texture selected based at least in part on the second surface tension.

9. The fluid-ejecting apparatus of claim 8, wherein the first surface tension is greater than the second surface tension and the first surface texture is smoother than the second surface texture.

10. The fluid-ejecting apparatus of claim 8, wherein the first and second surface textures are laser-ablated surface textures.

11. The fluid-ejecting apparatus of claim 10, wherein the first surface texture was formed using a first number of laser ablation shots and the second surface texture was formed using a second number of laser ablation shots, wherein the first number is greater than the second number.

12. The fluid-ejecting apparatus of claim 8, wherein the first and second counterbores are about the same depth.

13. The fluid-ejecting apparatus of claim 12, wherein the first and second counterbores are about 1.1 um deep.

14. A fluid-ejecting apparatus, comprising:

a substrate with a fluid ejector for ejecting at least a first fluid and a second fluid; and an orifice layer comprising at least a first orifice through which the first fluid is ejected and a second orifice through which the second fluid is ejected, the first fluid having a first surface tension and the second fluid having a second surface tension;

wherein the first orifice is surrounded by a first counterbore with a first counterbore surface having a first surface texture;

wherein the second orifice is surrounded by a second counterbore with a second counterbore surface having a second surface texture;

and wherein the first surface tension is greater than the second surface tension and the first surface texture is smoother than the second surface texture.

15. A fluid-ejecting apparatus, comprising:

a substrate with a fluid ejector for ejecting at least a first fluid; and an orifice layer comprising at least a first orifice through which the first fluid is ejected, wherein the orifice layer has a first counterbore that surrounds the first orifice, and wherein the first counterbore has a first surface characteristic selected based at least in part on the first fluid, wherein the first counterbore surface is wettable with respect to the first fluid;

wherein the orifice layer further comprises a second orifice through which a second fluid is ejected, wherein the orifice layer has a second counterbore that surrounds the second orifice, and wherein the second counterbore has a second surface characteristic selected based at least in part on the second fluid;

wherein the first fluid has a first surface tension which is lower than a second surface tension of the second fluid.

16. A fluid-ejecting apparatus, comprising:

a substrate with a fluid ejector for ejecting at least a first fluid; and an orifice layer comprising at least a first orifice through which the first fluid is ejected, wherein the orifice layer has a first counterbore that surrounds the first orifice, and wherein the first counterbore has a first surface characteristic selected based at least in part on the first fluid, wherein the first counterbore surface is wettable with respect to the first fluid;

wherein the orifice layer further comprises a second orifice through which a second fluid is ejected, wherein the orifice layer has a second counterbore that surrounds the second orifice, and wherein the second counterbore has a second surface characteristic selected based at least in part on the second fluid;

wherein the first fluid comprises black ink and the second orifice comprises a colored ink.

17. A fluid-ejecting apparatus, comprising:

a substrate with a fluid ejector for ejecting at least a first fluid; and an orifice layer comprising at least a first orifice through which the first fluid is ejected, wherein the orifice layer has a first counterbore that surrounds the first orifice, and wherein the first counterbore has a first surface characteristic selected based at least in part on the first fluid wherein the first counterbore surface is wettable with respect to the first fluid;

wherein the orifice layer further comprises a second orifice through which a second fluid is ejected, wherein the orifice layer has a second counterbore that surrounds the second orifice, and wherein the second counterbore has a second surface characteristic selected based at least in part on the second fluid;

wherein the second counterbore surface is less-wettable with respect to the second fluid than is the first counterbore surface with respect to the first fluid.

18. A fluid-ejecting apparatus, comprising:

a substrate with a fluid ejector for ejecting at least a first fluid; and an orifice layer comprising at least a first orifice through which the first fluid is ejected, wherein the orifice layer has a first counterbore that surrounds the first orifice, and wherein the first counterbore has a first surface characteristic selected based at least in part on the first fluid, wherein the first counterbore surface is wettable with respect to the first fluid;

wherein the orifice layer further comprises a second orifice through which a second fluid is ejected, wherein the orifice layer has a second counterbore that surrounds the second orifice, and wherein the second counterbore has a second surface characteristic selected based at least in part on the second fluid;

wherein the second counterbore surface is non-wettable.

* * * * *

UNITED STATES PATENT AND TRADEMARK OFFICE

CERTIFICATE OF CORRECTION

PATENT NO. : 6,938,986 B2
APPLICATION NO. : 10/136933
DATED : September 6, 2005
INVENTOR(S) : Michel Macler et al.

It is certified that error appears in the above-identified patent and that said Letters Patent is hereby corrected as shown below:

In column 10, line 9, delete "hexanediamino-methyidiethoxysilane" and insert -- hexanediamino-methyldiethoxysilane --, therefor.

In column 14, line 6, in Claim 17, after "fluid" insert -- , --.

Signed and Sealed this

Fourteenth Day of July, 2009

John Doll

JOHN DOLL
*Acting Director of the United States Patent and Trademark Office*